US009393819B2

(12) United States Patent
Hamano et al.

(10) Patent No.: US 9,393,819 B2
(45) Date of Patent: Jul. 19, 2016

(54) RECORDING APPARATUS AND RECORDING METHOD

(71) Applicant: SEIKO EPSON CORPORATION, Tokyo (JP)

(72) Inventors: Ryo Hamano, Matsumoto (JP); Toru Hayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/606,652

(22) Filed: Jan. 27, 2015

(65) Prior Publication Data

US 2015/0224796 A1 Aug. 13, 2015

(30) Foreign Application Priority Data

Feb. 10, 2014 (JP) ..... 2014-023085

(51) Int. Cl.
*B41J 11/04* (2006.01)
*B41J 15/04* (2006.01)
*B41J 11/00* (2006.01)

(52) U.S. Cl.
CPC ..... *B41J 15/04* (2013.01); *B41J 11/0075* (2013.01)

(58) Field of Classification Search
CPC ..... B41J 15/165
See application file for complete search history.

(56) References Cited

U.S. PATENT DOCUMENTS

| | | | | |
|---|---|---|---|---|
| 5,412,407 | A * | 5/1995 | Okubo et al. | 347/215 |
| 6,193,183 | B1 * | 2/2001 | Yoshizawa | 242/334.3 |
| 6,672,706 | B2 * | 1/2004 | Silverbrook | 347/42 |
| 8,002,214 | B2 * | 8/2011 | Genta et al. | 242/420.6 |
| 2003/0062440 | A1 * | 4/2003 | Ohshio et al. | 242/528 |
| 2008/0107468 | A1 * | 5/2008 | Silverbrook et al. | 400/613 |
| 2009/0226235 | A1 * | 9/2009 | Kobayashi et al. | 400/614 |
| 2012/0050435 | A1 * | 3/2012 | Sugiyama et al. | 347/102 |
| 2012/0050438 | A1 | 3/2012 | Wada | |
| 2014/0239113 | A1 * | 8/2014 | Igarashi | B65H 23/1825 242/420.5 |

FOREIGN PATENT DOCUMENTS

JP 2012-046307 3/2012

* cited by examiner

*Primary Examiner* — Stephen Meier
*Assistant Examiner* — John P Zimmermann
(74) *Attorney, Agent, or Firm* — Workman Nydegger

(57) ABSTRACT

A recording apparatus includes a recording section that performs recording on a recording medium, a rotation section that sends out the recording medium by rotating a roll of the recording medium or rolls up the recording medium into a roll, and a roll diameter estimation section that estimates the roll diameter of the recording medium present in the rotation section. The roll diameter estimation section is capable of estimating the roll diameter during the recording performed by the recording section. The thus-configured recording apparatus estimates the roll diameter of the recording medium in real time during recording.

6 Claims, 4 Drawing Sheets

RECORDING APPARATUS AND RECORDING METHOD

BACKGROUND

1. Technical Field

The present invention relates to a recording apparatus and a recording method.

2. Related Art

According to the related art, recording apparatuses equipped with a send-out section that feeds a recording medium by rotating a roll of the recording medium and a take-up section that rolls up the recording medium into a rolled state have been used. For example, JP-A-2012-46307 discloses a recording apparatus that includes a sheet feed section as the aforementioned send-out section, and a take-up section, and is capable of measuring the diameter or radius of rolls of a recording medium present in the sheet feed section and the take-up section.

As in the recording apparatus disclosed in JP-A-2012-46307, related-art recording apparatuses equipped with a send-out section that rotates a roll of a recording medium to feed the recording medium and a take-up section that rolls up the recording medium into a roll are capable of measuring the diameter of the rolls of the recording medium present in the send-out section and the take-up section. These recording apparatuses are configured to estimate the roll diameters before recording starts and after recording ends. For example, the recording apparatus disclosed in JP-A-2012-46307 is configured to calculate the radius of the roll of the sheet feed section and the radius of the roll of the take-up section by using a "conveyance distance of the continuous sheet from the start to end of the current printing action", which is "stored in the conveyance-length storage unit". That is, the recording apparatus is configured to estimate the roll diameters after a continuous process of recording ends (after the aforementioned printing ends).

However, in the case where a continuous recording process is performed on an elongated recording medium, the roll diameter sometimes changes greatly from before recording starts to after the recording ends. Therefore, sometimes when the roll diameters greatly change during recording but the recording apparatus is not able to detect the changes of the roll diameters, problems sometimes occur. For example, because, during recording, the roll diameters change greatly but the recording apparatus is not able to detect the changes of the roll diameters, the rolled-up recording medium has wrinkles, rolling deviation, or slack, and the recorded image sometimes has banding (band unevenness) etc. Therefore, the roll diameters of the recording medium are desired to be estimated in real time during recording.

SUMMARY

An advantage of some aspects of the invention is that the diameter or radius of a roll of a recording medium can be estimated in real time during recording of the recording medium.

In order to solve the aforementioned problem, a recording apparatus according to a first aspect of the invention includes a recording section that performs recording on a recording medium, a rotation section that rotates the recording medium in a rolled state, and a roll diameter estimation section that estimates a roll diameter of the recording medium present in the rotation section. The roll diameter estimation section is capable of estimating the roll diameter during the recording performed by the recording section.

According to this aspect, the roll diameter estimation section is capable of estimating the roll diameter during recording performed by the recording section. Therefore, the roll diameter of the recording medium can be estimated in real time during recording.

It is preferable that the recording apparatus further include a transport section that transports the recording medium and the roll diameter estimation section be capable of estimating the roll diameter based on an amount of transport of the recording medium caused by the transport section and an amount of rotation of the rotation section.

Related-art recording apparatuses are typically configured to estimate the roll diameter of the recording medium based on the thickness of the recording medium and the amount of the recording medium transported. However, the thickness of the recording medium is subject to a large estimate error depending on how the recording medium is rolled, or the like.

According to the foregoing embodiment of the invention, the roll diameter estimation section is capable of estimating the roll diameter based on the amount of transport of the recording medium brought about by the transport section and the amount of rotation of the rotation section, so that the roll diameter can be estimated more accurately.

It is preferable that the recording apparatus further include a rotation load estimation section capable of estimating a rotation load on the rotation section during the recording based on the roll diameter estimated by the roll diameter estimation section.

According to this embodiment of the invention, because of including the rotation load estimation section, the recording apparatus is able to estimate not only the roll diameter, but also the rotation load in real time during recording.

It is preferable that the rotation section of the recording apparatus be a send-out section that sends out the recording medium.

According to this embodiment, the recording apparatus equipped with the send-out section can estimate the roll diameter of the recording medium in the send-out section in real time during recording.

It is preferable that the rotation section of the recording apparatus be a take-up section that rolls up the recording medium.

According to this embodiment, the recording apparatus equipped with the take-up section can estimate the roll diameter of the recording medium in the take-up section in real time during recording.

A recording method according to a second aspect of the invention is a recording method for a recording apparatus that includes a recording section that performs recording on a recording medium, and a rotation section that rotates the recording medium in a rolled state. The recording method includes estimating a roll diameter of the recording medium during the recording performed by the recording section.

According to this aspect of the invention, in the roll diameter estimation, the roll diameter is estimated during recording performed by the recording section. Therefore, the roll diameter of the recording medium can be estimated in real time during recording.

It is preferable that the recording method be a recording method for a recording apparatus that further includes a transport section that transports the recording medium and the estimating of the roll diameter be performed based on an amount of transport of the recording medium caused by the transport section and an amount of rotation of the rotation section.

According to this embodiment, since the roll diameter is estimated from the amount of transport of the recording medium caused by the transport section and the amount of rotation of the rotation section, the roll diameter can be estimated more accurately.

It is preferable that the recording method further include estimating a rotation load on the rotation section during the recording, based on the roll diameter estimated in the estimating of the roll diameter.

According to this embodiment, because of the rotation load estimation, the rotation load as well as the roll diameter can be estimated in real time during recording.

BRIEF DESCRIPTION OF THE DRAWINGS

The invention will be described with reference to the accompanying drawings, wherein like numbers reference like elements.

DESCRIPTION OF EXEMPLARY EMBODIMENTS

Recording apparatuses according to exemplary embodiments of the invention will be described hereinafter with reference to the accompanying drawings.

Figure 1:
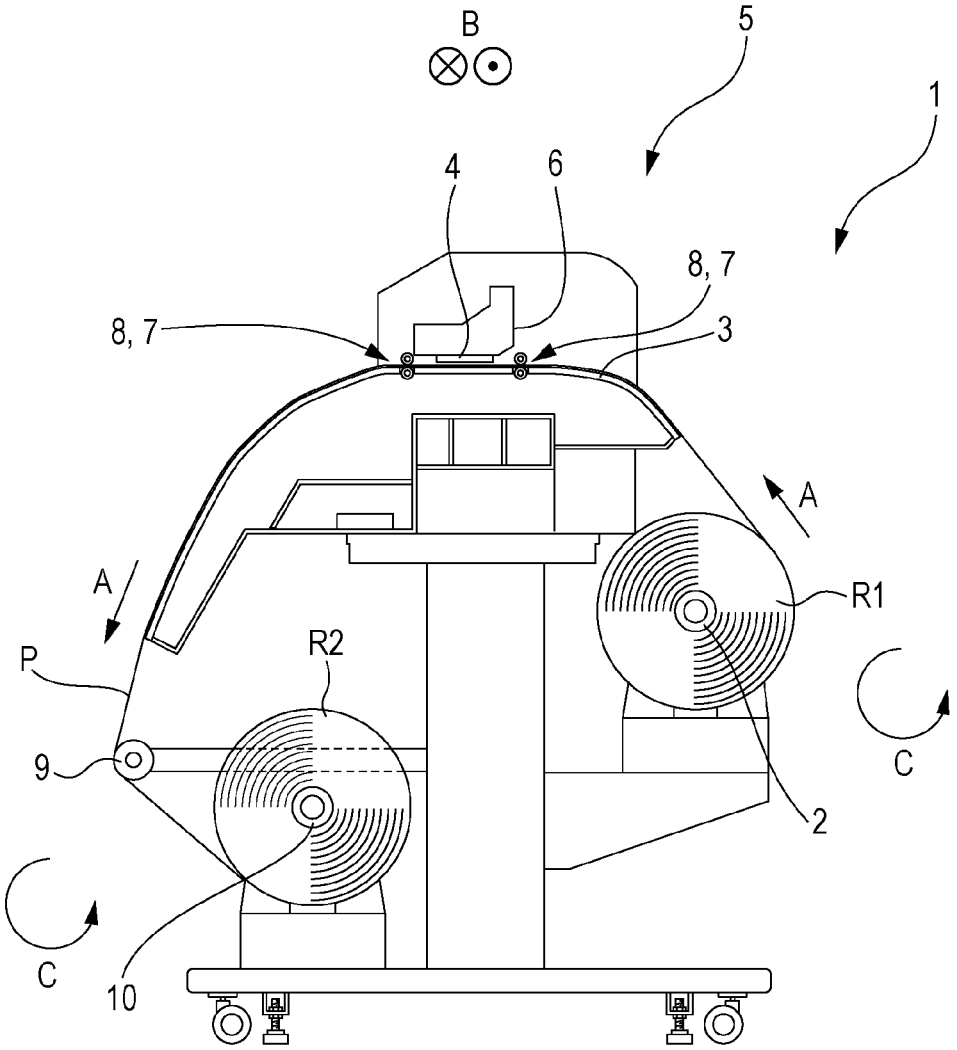
FIG. 1 is a schematic side view of a recording apparatus according to an exemplary embodiment of the invention.
Figure 2:
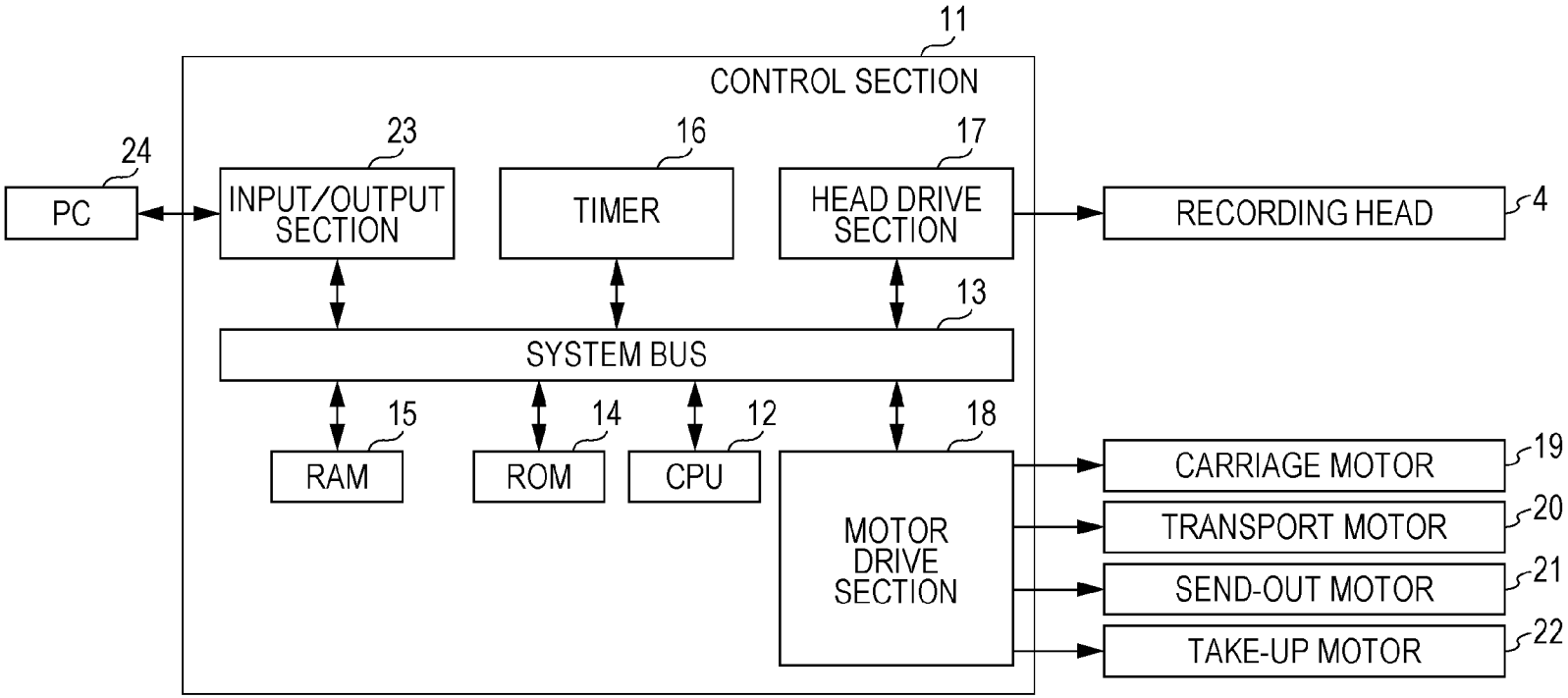
FIG. 2 is a block diagram of the recording apparatus according to the exemplary embodiment.
Figure 3:
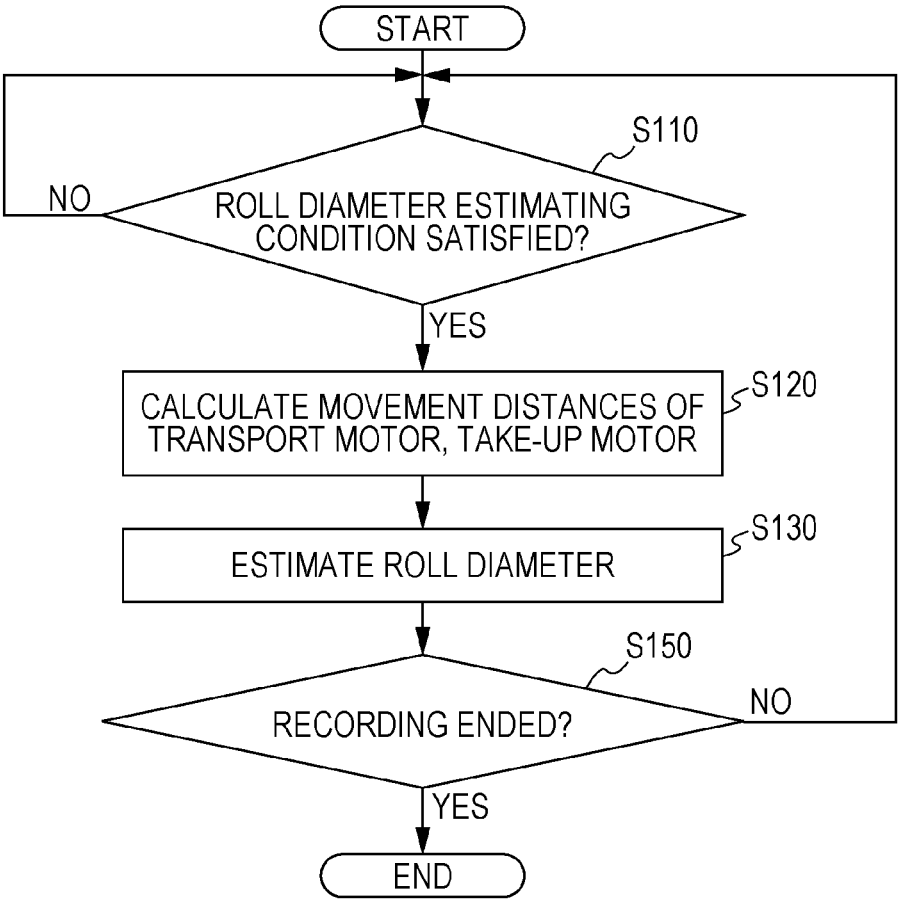
FIG. 3 is a flowchart illustrating the recording method according another exemplary embodiment.

Embodiment of Recording Apparatus (FIGS. 1 to 3)

First, a recording apparatus according to an exemplary embodiment of the invention will be described.

FIG. 1 is a schematic side view of a recording apparatus 1 according to this embodiment.

The recording apparatus 1 of this embodiment includes a support spindle 2 as a medium setting portion that supports a roll R1 of a recording medium P in a rolled state on which recording is to be performed. In the recording apparatus 1 of this embodiment, when the recording medium P is transported in a transport direction A, the support spindle 2 is rotated in a rotation direction C. Incidentally, in this embodiment, a roll-type recording medium P that has been rolled so that a recording surface of the recording medium P faces outward is used. However, if a roll-type recording medium P rolled so that the recording surface thereof faces inward is used, the support spindle 2 can be rotated in the direction opposite to the rotation direction C to feed the recording medium P from the roll R1.

The recording apparatus 1 of this embodiment further includes a medium support section 3 that supports the recording medium P and a transport section 7 that is constructed of a transport roller pair 8 for transporting the recording medium P in the transport direction A. Furthermore, a lower portion of the medium support section 3 is provided with a heater (not shown) that is capable of heating the recording medium P that is supported by the medium support section 3.

Incidentally, the recording apparatus 1 of this embodiment is equipped with a heater capable of heating the recording medium P from the medium support section 3 side. However, the recording apparatus 1 may include an infrared heater that is provided at such a position as to face the medium support section 3. In the case where an infrared heater is employed, a preferable infrared wavelength is 0.76 to 1000 μm. Generally, the infrared radiation can be divided into near-infrared radiation, intermediate-infrared radiation, and far-infrared radiation. Although it varies how these ranges of infrared radiation are divided, the approximate wavelength ranges of the three divisions are 0.78 to 2.5 μm, 2.5 to 4.0 μm, and 4.0 to 1000 μm. Among these, the intermediate infrared radiation is preferred to be employed.

The recording apparatus 1 of this embodiment further includes a recording mechanism 5 that moves a carriage 6 on which the recording head 4 is mounted back and forth in directions B that intersect the transport direction A of the recording medium P and that simultaneously discharges ink from a plurality of nozzles provided in a nozzle surface of the recording head 4 to perform recording.

Incidentally, although the recording apparatus 1 of this embodiment is equipped with the recording head 4 that performs recording while being moved back and forth, this embodiment is also applicable to a recording apparatus that includes a so-called line head in which a plurality of nozzles that discharge ink are provided in a direction that intersects the transport direction A.

The "line head" herein is a recording head in which a region of nozzles formed in the directions B that intersect the transport direction A of the recording medium P is provided so as to cover the entire width of the recording medium P in the directions B and which is for use in a recording apparatus that forms an image by moving one of a recording head and a recording medium while securing the other. Incidentally, the region of nozzles of a line head extending in the directions B does not need to be capable of covering the entire width of the recording medium P in the directions B.

Furthermore, the recording apparatus of the invention may be a recording apparatus that has a recording section other than the ink jet type recording head.

Furthermore, a take-up spindle 10 as a take-up section capable of rolling up the recording medium P into a roll R2 is provided at a downstream side of the recording mechanism 5 in the transport direction A of the recording medium P. Incidentally, in this embodiment, the recording medium P is rolled up so that the recording surface is outside; therefore, when the recording medium P is rolled up, the take-up spindle 10 is rotated in a rotation direction C. On the other hand, in the case where the recording medium P is rolled up so that the recording surface is inside, the take-up spindle 10 can be rotated in the direction opposite to the rotation direction C to roll up the recording medium P.

Furthermore, between a downstream-side end portion of the medium support section 3 in the transport direction A of the recording medium P and the take-up spindle 10, there is provided a stationary bar member 9 whose contact portion with the recording medium P extends in the directions B. The stationary bar member 9 forms a transport path of the recording medium P between the downstream-side end of the medium support section 3 and the take-up spindle 10.

Next, an electrical configuration of the recording apparatus 1 of this embodiment will be described.

FIG. 2 is a block diagram of the recording apparatus 1 of this embodiment.

A control section 11 is provided with a CPU 12 that performs overall control of the recording apparatus 1. The CPU 12 is connected, via a system bus 13, to a ROM 14 that stores various control programs that the CPU 12 executes, etc., a RAM 15 capable of temporarily storing data, and a timer 16 capable of measuring time.

Furthermore, the CPU 12 is connected, via the system bus 13, to a head drive section 17 for driving the recording head 4.

Furthermore, the CPU 12 is connected, via the system bus 13, to a motor drive section 18 that is connected to a carriage motor 19, a transport motor 20, a send-out motor 21, and a take-up motor 22.

The carriage motor 19 is a motor for moving the carriage 6 that carries thereon the recording head 4 in the directions B. Furthermore, the transport motor 20 is a motor for driving a transport roller pair 8 provided in a transport section 7. The send-out motor 21 is a rotation mechanism for the support spindle 2, and is a motor for driving the support spindle 2 in order to feed the recording medium P toward the transport section 7. Further, the take-up motor 22 is a drive motor for rotating the take-up spindle 10.

The CPU 12 is also connected, via the system bus 13, to an input/output section 23 that is connected to a PC (Personal Computer) 24 for sending/receiving signals and data such as recorded data, etc.

In the recording apparatus 1 of this embodiment, which is configured as described above, the support spindle 2 corresponds to a rotation section and a send-out section, the take-up spindle 10 corresponds to the rotation section and a take-up section, and the control section 11 corresponds to a roll diameter estimation section and a rotation load estimation section in the invention.

Next, a procedure of estimating the roll diameter (roll's outside diameter D) of the recording medium P on a rotation section of the recording apparatus 1 in real time during recording will be described. Incidentally, although in the following description the take-up spindle 10 is used as the aforementioned rotation section, the support spindle 2 can also be similarly used as the rotation section. Furthermore, the calculations, setting the settings and estimations in the following procedure are carried out by the control section 11.

The recording apparatus 1 of this embodiment has encoders that are provided for the transport section 7, the support spindle 2, and the take-up spindle 10. The recording apparatus 1 is configured to be capable of detecting, through the use of the encoders, the amounts of rotation of the transport motor 20, the send-out motor 21, and the take-up motor 22.

Due to this configuration, the amount of transport of the recording medium P can be calculated from the amount of rotation of the transport motor 20 of the transport section 7.

An execution condition for estimating the roll's outside diameter D in real time during recording is that the take-up spindle 10, as a rotation section, has rotated a predetermined amount of rotation ROLL_REVOLUT_CNT or more from a reference position at which the roll's outside diameter D is estimated (the position at which the roll's outside diameter D was previously updated) Roll_Base_Pos in the rotation direction C. Specifically, the execution condition is that a roll R2 of the recording medium P has rotated a predetermined amount of rotation or more in the rotation direction C from the position at which the roll's outside diameter D was previously updated.

Therefore, satisfaction of the execution condition corresponds to the case where if the count value (read value) of the encoder of the take-up motor 22 obtained for one rotation of the roll R2 of the recording medium P is represented as ROLL_ROUND_LEN, the movement distance Roll_Len from the reference position of the take-up motor 22 (the movement distance based on the amount of rotation of the take-up spindle 10 from the position at which the roll's outside diameter D was previously updated) satisfies a condition expressed by the following expression.

$$\text{Roll_Len} > \text{ROLL_ROUND_LEN} \times \text{ROLL_REVOLUT_CNT} \quad (1)$$

In the case where the roll's outside diameter D is estimated in real time during recording, the movement distance PF_Len based on the amount of rotation of the transport motor 20 from the position assumed at the time of the previous update of the roll's outside diameter D and the movement distance Roll_Len based on the amount of rotation of the take-up motor 22 from the position assumed at the time of the previous update of the roll's outside diameter D are calculated.

Herein, PF_CurtPos represents the present position of the transport motor 20 based on the count value of the encoder of the transport motor 20. PF_BasePos represents a reference position of the transport motor 20.

Furthermore, Roll_CurtPos represents the present position of the take-up motor 22 based on the count value of the encoder of the take-up motor 22. Roll_BasePos represents a reference position of the take-up motor 22.

These can be expressed as follows:

$$PF_\text{Len} = PF_\text{CurtPos} - PF_\text{BasePos} \quad (2)$$

$$\text{Roll_Len} = \text{Roll_CurtPos} - \text{Roll_BasePos} \quad (3)$$

Then, using the movement distance PF_Len and the movement distance Roll_Len, the roll's outside diameter RD is calculated in real time during recording.

Herein, PF_Round_Len represents the count value of the encoder of the transport motor 20 obtained for one rotation of the roll R2 of the recording medium P. ROLL_D_CON is a coefficient for converting the movement distance of the transport motor 20 for one rotation of the roll R2 of the recording medium P into the roll's outside diameter D. BIT_D represents the number of bits for avoiding loss of significant digits in the estimate calculation of the roll's outside diameter D.

$$PF_\text{Round_Len} = ((PF_\text{Len}/2^7) \times \text{ROLL_ROUND_LEN})/(\text{Roll_Len}/2^7) \quad (4)$$

$$RD = (PF_\text{Round_Len} \times \text{ROLL_}D\text{_CON})/2^{BIT_D} \quad (5)$$

Incidentally, if the calculated real-time value of roll's outside diameter RD is not within the pre-set range of a lower limit to an upper limit of an estimate of the outside diameter, the previously calculated value of the roll's outside diameter D is set as a real-time roll's outside diameter RD.

As described above, the recording apparatus 1 of this embodiment includes the recording head 4 that performs recording on the recording medium P, the support spindle 2 as a rotation section that rotates the roll of the recording medium P so as to feed the recording medium P, the take-up spindle 10 as a rotation section that rolls up the recording medium into a roll, and the control section 11 as the roll diameter estimation section that estimates the roll diameter of the recording medium P on the rotation section. The control section 11 is capable of estimating the roll diameter during recording performed by the recording head 4.

Herein, the meaning of the phrase "during recording performed by the recording head 4" includes when recording by the recording head 4 is being performed, and also the time of transition from the movement of the recording head 4 in one of the directions to the movement thereof in the other direction.

The control section 11 in this embodiment is capable of estimating the roll diameter during recording performed by the recording head 4. Therefore, the recording apparatus 1 is configured to be capable of estimating the roll diameter of the recording medium P in real time during recording.

Furthermore, as described above, the recording apparatus 1 of this embodiment includes the transport section 7 that transports the recording medium P, and the control section 11 is capable of estimating the roll diameter from the amount of transport of the recording medium P carried out by the transport section 7 and the amount of rotation of the rotation section.

Related-art recording apparatuses are typically configured to estimate the roll diameter from the thickness of the recording medium P and the amount of transport of the recording medium P. However, the thickness of the recording medium P is subject to a large estimate error depending on the way of rolling the recording medium P.

The control section 11 in this embodiment is capable of estimating the roll diameter from the amount of transport of the recording medium P brought about by the transport section 7 and the amount of rotation of the rotation section, so that the roll diameter can be estimated more accurately. Therefore, the recording apparatus 1 of this embodiment is configured to be capable of estimating the roll diameter more accurately than the related-art recording apparatuses that estimate the roll diameter from the thickness of the recording medium P and the amount of transport of the recording medium P.

Furthermore, as described above, the recording apparatus 1 of this embodiment includes as the rotation section the support spindle 2 that rotates the rolled recording medium P to feed the recording medium P.

Therefore, the roll diameter of the recording medium P on the support spindle 2 can be estimated in real time during recording.

Furthermore, the recording apparatus 1 of this embodiment includes as the rotation section the take-up spindle 10 that rolls up the recording medium P into a rolled state.

Therefore, the roll diameter of the recording medium P on the take-up spindle 10 can be estimated in real time during recording.

Next, a procedure of estimating the rotation load on the aforementioned rotation section on the basis of the real-time value of roll's outside diameter RD estimated as described above. Incidentally, although in the following description, the take-up spindle 10 is used as the aforementioned rotation section, the support spindle 2 can also be similarly used as the rotation section.

Incidentally, the recording apparatus 1 of this embodiment estimates the rotation load on the rotation section (the value of electric current that flows when the take-up spindle 10 rotates, which will also be referred to as "measurement value") every time the roll's outside diameter D is updated (to the real-time roll's outside diameter RD). The calculations, setting of settings, and estimations performed in the following procedure are performed by the control section 11.

First, during an initial state, the measurement value of the take-up spindle 10 is measured at two rotation speeds, that is, a low speed and a high speed.

Then, from the results of measurement of the measurement values corresponding to the two kinds of rotation speed, that is, the low speed and the high speed, and the roll's outside diameter D, an intercept m_bL (low-speed side) and an intercept m_bH (high-speed side) of linear expressions for estimating the measurement value are determined as shown by the following expressions.

In the expressions, AveTi_rest_ROLL_L is the low-speed-side measurement value calculated according to a predetermined measurement sequence, and AveTi_rest_ROLL_H is the high-speed-side measurement value calculated according to the predetermined measurement sequence. Furthermore, m_slope_L is the low-speed-side slope of the measurement value estimation expression, and m_slope_H is the high-speed-side slope of the measurement value estimation expression. PW is the width of the recording medium P (the length thereof in the direction B), and PW_base is a reference width of a predetermined recording medium P. Further, m_bit is a constant for avoiding the loss of significant digits.

$$m_bL=\text{AveTi_rest_ROLL_}L\times(((m_\text{slope_}L\times PW)/PW_\text{base})\times D^2)/2^{m_bit} \quad (6)$$

$$m_bH=\text{AveTi_rest_ROLL_}H\times(((m_\text{slope_}H\times PW)/PW_\text{base})\times D^2)/2^{m_bit} \quad (7)$$

Next, every time the real-time roll's outside diameter RD is updated, the measurement value expressed by the following expression is calculated.

In the following expressions, m_L represents the low-speed-side measurement value, and m_H represents the high-speed-side measurement value.

$$m_L=(((m_\text{slope_}L\times PW)/PW_\text{base})\times D^2)/2^{m_bit}+m_bL \quad (8)$$

$$m_H=(((m_\text{slope_}H\times PW)/PW_\text{base})\times D^2)/2^{m_bit}+m_bH \quad (9)$$

Incidentally, if the calculated measurement values m_L and m_H are not within the range of the lower limit to the upper limit of the outside diameter estimate, the update of the measurement values is not carried out.

As described above, the control section 11 in this embodiment is capable of estimating the rotation load on the rotation section during recording from the roll diameter estimated by the control section 11.

Figure 4:
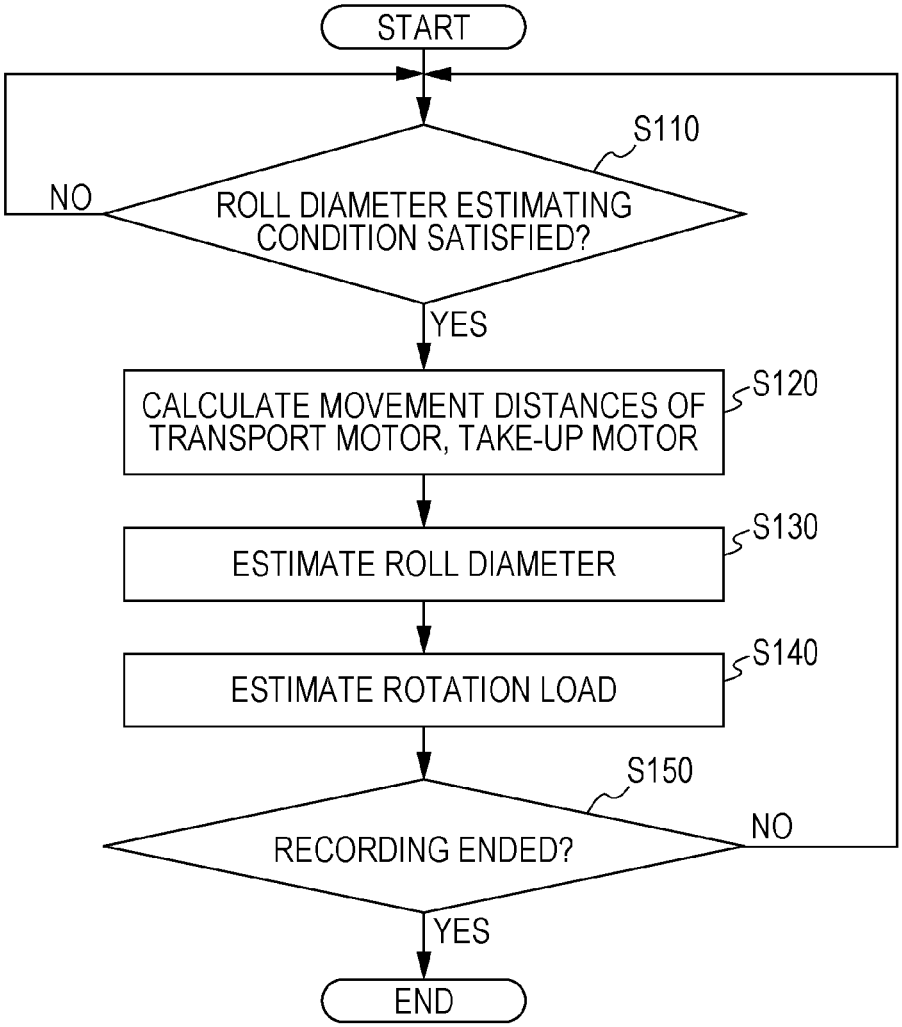
FIG. 4 is a flowchart illustrating a recording method according to yet another exemplary embodiment of the invention.

Thus, the recording apparatus 1 is configured to be capable of estimating not only the roll diameter but also the rotation load in real time during recording. Embodiments of Recording Method (FIGS. 3 and 4)

Next, a recording method according to the invention will be described with reference to a flowchart.

Incidentally, although in the following description, the take-up spindle 10 is used as the aforementioned rotation section, the support spindle 2 can also be similarly used as the rotation section.

FIG. 3 is a flowchart of the recording method of this embodiment.

First, after the control section 11 receives an input of recording data and starts recording, the control section 11 determines in step S110 whether a condition for estimating the real-time roll's outside diameter RD is satisfied. Specifically, the control section 11 determines whether the roll R2 of the recording medium P has rotated at least a predetermined amount of rotation in the rotation direction C from the position at which the roll's outside diameter D was previously updated.

If in step S110 it is determined that the condition for estimating the real-time roll's outside diameter RD is satisfied, the process proceeds to step S120.

Next, in step S120, the control section 11 calculates the movement distance based on the amount of rotation of the transport motor 20 from the position of the previous update of the roll's outside diameter D and the movement distance based on the amount of rotation of the take-up motor 22 from the position of the previous update of the roll's outside diameter D.

Next, in a roll diameter estimation in step S130, the real-time roll's outside diameter RD during recording is calculated (estimated) by using the movement distance of the transport motor 20 and the movement distance of the take-up motor 22.

Then, the process proceeds to step S150. Due to step S150, the process from step S110 to step S150 is repeated until the recording based on the input recording data received by the control section 11 ends. Then, the recording method of this embodiment ends.

FIG. 4 is a flowchart of a recording method an embodiment different from the foregoing embodiment.

Specifically, the recording method of this embodiment further has a rotation load estimation of estimating the rotation load on the take-up spindle 10.

In the recording method of this embodiment, the process of steps S110 to S130 is substantially the same as that in the recording method of the embodiment described above with reference to FIG. 3 and, therefore, will not be described in detail below.

In the recording method of this embodiment, after step S130 ends, the process proceeds to a rotation load estimation in step S140. In step S140, the rotation load (measurement value) on the take-up spindle 10 is estimated by using the real-time roll's outside diameter RD estimated in step S130 and a predetermined measurement value estimation expression.

Incidentally, in the recording method in this embodiment, the intercept of the measurement value estimation expression is calculated and stored in the ROM 14 before the control section 11 receives an input of recording data.

After step S140 ends, the process proceeds to step S150, which is substantially the same as that in the recording method of the embodiment described above with reference to FIG. 3 and, therefore, will not be described in detail again.

The entire disclosure of Japanese Patent Application No. 2014-023085, filed Feb. 10, 2014 is expressly incorporated by reference herein.

What is claimed is:

1. A recording apparatus comprising:

a recording section including a recording head that performs recording on a recording medium;

a rotation section that rotates the recording medium in a rolled state;

a roll diameter estimation section that estimates a roll diameter of the recording medium present in the rotation section, the roll diameter estimation section being capable of estimating the roll diameter during the recording performed by the recording section; and a rotation load estimation section capable of estimating a rotation load on the rotation section during the recording performed by the recording head based on the roll diameter estimated by the roll diameter estimation section, wherein the roll diameter estimation section estimates if the roll of the recording medium has rotated at least a predetermined amount of rotation in a rotation direction prior to estimating the roll diameter.

2. The recording apparatus according to claim 1, further comprising a transport section that transports the recording medium, wherein the roll diameter estimation section is capable of estimating the roll diameter based on an amount of transport of the recording medium caused by the transport section and an amount of rotation of the rotation section.

3. The recording apparatus according to claim 1, wherein the rotation section is a send-out section that sends out the recording medium.

4. The recording apparatus according to claim 1, wherein the rotation section is a take-up section that rolls up the recording medium.

5. A recording method for a recording apparatus that includes a recording section including a recording head that performs recording on a recording medium, and a rotation section that rotates the recording medium in a rolled state, the recording method comprising:

estimating if a roll of the recording medium has rotated at least a predetermined amount of rotation in a rotation direction prior to estimating a roll diameter of the recording medium;

estimating the roll diameter of the recording medium during the recording performed by the recording head of the recording section; and estimating a rotation load on the rotation section during the recording performed by recording head, based on the roll diameter estimated in the estimating of the roll diameter.

6. The recording method according to claim 5, wherein the recording apparatus further includes a transport section that transports the recording medium, and wherein the estimating of the roll diameter is performed based on an amount of transport of the recording medium caused by the transport section and an amount of rotation of the rotation section.

* * * * *